US011391533B2

(12) United States Patent
Favory

(10) Patent No.: US 11,391,533 B2
(45) Date of Patent: Jul. 19, 2022

(54) RIFLE BIPOD

(71) Applicant: MCEWIN DESIGN PTY LTD, Bayswater (AU)

(72) Inventor: Corey Favory, Bayswater (AU)

(73) Assignee: MCEWIN DESIGN PTY LTD, Western (AU)

( * ) Notice: Subject to any disclaimer, the term of this patent is extended or adjusted under 35 U.S.C. 154(b) by 0 days.

(21) Appl. No.: 16/960,354

(22) PCT Filed: Jan. 8, 2019

(86) PCT No.: PCT/AU2019/050004
§ 371 (c)(1),
(2) Date: Jul. 7, 2020

(87) PCT Pub. No.: WO2019/134020
PCT Pub. Date: Jul. 11, 2019

(65) Prior Publication Data

US 2021/0063107 A1 Mar. 4, 2021

(30) Foreign Application Priority Data

Jan. 8, 2018 (AU) ..... 2018900044

(51) Int. Cl.
*F41A 23/10* (2006.01)

(52) U.S. Cl.
CPC ..... *F41A 23/10* (2013.01)

(58) Field of Classification Search
CPC ..... F41A 23/10; F41A 23/02; F41A 23/04; F41A 23/06; F41A 23/08
See application file for complete search history.

(56) References Cited

U.S. PATENT DOCUMENTS 271,251 A * 1/1883 Leerbech et al. ..... F41A 23/10 42/94
681,439 A * 8/1901 Carr ..... F41A 19/33 89/140

(Continued)

FOREIGN PATENT DOCUMENTS

| | | |
|---|---|---|
| EP | 0127193 A1 | 12/1984 |
| GB | 183494 A | 7/1922 |
| GB | 2017879 B | 10/1982 |

OTHER PUBLICATIONS

International Search Report and Written Opinion for international application No. PCT/AU2019/050004, filed Jan. 8, 2019.

*Primary Examiner* — Michelle Clement
(74) *Attorney, Agent, or Firm* — Michael J. Feigin, Esq.; Feigin and Fridman LLC

(57) ABSTRACT

A rifle bipod with a rifle support for operatively receiving and supporting a portion of a rifle, as well as two legs each having a tubular upper and lower portion and telescopically arranged with an urging element urging the portions and into an extended position is disclosed with a cam lock arrangement allowing infinite length adjustability between the telescoping upper and lower portions. Each leg has a foot attachment to releasably receive interchangeable feet whereby each leg is operatively able to engage a surface. Bipod also includes a stabilising arrangement pivotably attaching the legs to the rifle support at a commensurate off-vertical angle with a biasing element to operatively bias both legs towards each other. The stabilising arrangement includes a linkage to maintain the off-vertical angle commensurate as the legs pivot apart, wherein the rifle support is height adjustable via the telescoping legs and the linkage maintaining the off-vertical angle.

19 Claims, 7 Drawing Sheets

(56) References Cited

U.S. PATENT DOCUMENTS 2,436,349 A * 2/1948 Adams ..... F41A 23/08 42/94
2,489,283 A * 11/1949 Garand ..... F41A 23/08 42/94
2,807,904 A * 10/1957 Kreske ..... F41A 23/08 42/94
3,235,998 A * 2/1966 Hadley ..... F41A 23/08 42/94
3,327,422 A * 6/1967 Harris ..... F41A 23/08 42/94
4,570,887 A * 2/1986 Banister ..... F16M 11/041 248/187.1
4,607,561 A * 8/1986 Frimer ..... F41A 23/08 89/37.04
4,625,620 A * 12/1986 Harris ..... F41A 23/08 42/94
5,074,188 A * 12/1991 Harris ..... F41A 23/08 89/37.04
5,094,418 A * 3/1992 McBarnes, Jr. ..... A61G 7/0503 248/125.1
5,345,706 A * 9/1994 Brown ..... F41A 23/06 42/94
5,351,867 A * 10/1994 Vest ..... F16M 13/04 224/661
5,438,786 A * 8/1995 Hilderbrand ..... F41A 23/14 248/171
5,815,974 A * 10/1998 Keng ..... F41A 23/10 42/94
6,050,531 A * 4/2000 Wilcox ..... A47B 19/002 248/188.5
6,254,044 B1 * 7/2001 Lee ..... F16M 11/14 248/163.1
6,289,622 B1 * 9/2001 Desch, Jr. ..... F41A 23/10 42/94
6,305,116 B1 * 10/2001 Parker ..... F41A 23/04 42/94
6,763,627 B1 * 7/2004 Kaempe ..... F41A 23/10 42/94
6,785,997 B2 * 9/2004 Oz ..... F41G 1/35 42/146
7,347,402 B2 * 3/2008 White ..... F16M 11/14 124/86
7,401,431 B2 * 7/2008 Pierce ..... F41A 23/08 42/94
7,426,800 B2 * 9/2008 Pierce ..... F41A 23/10 248/166
7,676,977 B1 * 3/2010 Cahill ..... F41G 11/003 42/94
7,793,454 B1 * 9/2010 Beltz ..... F41A 23/10 42/94
8,104,213 B2 * 1/2012 Keng ..... F41A 23/10 42/94
8,316,570 B2 * 11/2012 Potterfield ..... F41A 23/10 42/94
8,496,212 B2 * 7/2013 Keng ..... F41A 23/10 248/166
9,121,665 B2 * 9/2015 Hinds ..... F41A 23/10
9,568,270 B1 * 2/2017 LoRocco ..... F41B 5/14
9,903,528 B1 * 2/2018 Hatch ..... F16B 7/1409
10,139,183 B1 * 11/2018 Liu ..... F41A 23/10
10,295,292 B2 * 5/2019 Ding ..... F16M 11/28
10,386,011 B2 * 8/2019 Hatch ..... F16M 11/26
10,393,465 B2 * 8/2019 Cheng ..... F41A 23/10
10,408,555 B2 * 9/2019 Flood, Jr. ..... F41A 23/10
11,125,525 B2 * 9/2021 Barnett ..... F41A 23/10
2003/0042388 A1 * 3/2003 Peterson ..... F16M 11/28 248/440.1
2005/0241206 A1 * 11/2005 Teetzel ..... F41A 23/08 42/72
2005/0242250 A1 * 11/2005 Keng ..... F16M 11/26 248/168
2006/0248774 A1 * 11/2006 Pierce ..... F41A 23/10 42/94
2006/0278797 A1 * 12/2006 Keng ..... F41A 23/54 248/440.1
2008/0295379 A1 * 12/2008 Potterfield ..... F41A 23/10 42/94
2009/0000175 A1 * 1/2009 Potterfield ..... F41A 23/10 42/94
2009/0038200 A1 * 2/2009 Keng ..... F41A 23/10 42/94
2009/0126250 A1 * 5/2009 Keng ..... F41A 23/10 42/94
2010/0005696 A1 * 1/2010 Moody ..... F41C 23/16 42/94
2010/0084524 A1 * 4/2010 Faifer ..... F16M 13/00 248/170
2010/0218411 A1 * 9/2010 Keng ..... F41A 23/10 42/94
2012/0266513 A1 * 10/2012 Gnesda ..... F41C 23/12 42/72
2013/0205639 A1 * 8/2013 Poling ..... F41A 23/08 42/94
2014/0115940 A1 * 5/2014 Bonelli ..... F16M 11/38 42/94
2014/0190060 A1 * 7/2014 Sherman ..... F41A 23/02 42/94
2015/0241160 A1 * 8/2015 McGinty ..... F41A 23/10 42/94
2015/0362278 A1 * 12/2015 Genchel ..... F16M 11/32 42/94
2017/0159882 A1 * 6/2017 Moody ..... F41C 23/16
2017/0248385 A1 * 8/2017 Yehle ..... F41A 23/10
2018/0202746 A1 * 7/2018 Flood, Jr. ..... F41A 23/10
2019/0093976 A1 * 3/2019 Power ..... F16F 9/34
2020/0300573 A1 * 9/2020 Barnett ..... F41A 23/10

* cited by examiner

RIFLE BIPOD

TECHNICAL FIELD

This invention relates to a rifle bipod and an associated method of supporting a rifle.

BACKGROUND ART

The following discussion of the background art is intended to facilitate an understanding of the present invention only. The discussion is not an acknowledgement or admission that any of the material referred to is or was part of the common general knowledge as at the priority date of the application.

When shooting rifles and other firearms, especially in stressful tactical situations, it is important that the firearm be maintained in a steady, stable position to insure accuracy of aim. Most shooters are not able to hold a firearm consistently in a set position without wavering, especially after the onset of fatigue resulting from strain due to the size and weight of the firearm. Accordingly, peripheral support devices have been used in conjunction with firearms since the early creation of firearms as a means of stabilising a firearm to reduce vibration and wavering and to improve accuracy.

In the past, shooters have used everything from large stationary objects such as rocks and tree branches to forked sticks, shooting slings, bipods and tripods. Early bipod and tripod supports were typically somewhat crude stands that generally were bulky, inconvenient and difficult to use and typically were not easily adjustable. In more recent times, bipod supports have been developed that are compact and relatively lightweight and are mountable to the forearm stock of a firearm, such as a rifle, to make the bipods portable with the firearm.

As is known in the art, a bipod is an attachment, usually to a weapon, that helps support and steady it. The bipod generally provides significant stability along two axes of motion (side-to-side, and up-and-down). On firearms, bipods are commonly used on rifles and machine guns to provide a forward rest and reduce motion. They are also seen on other long-barreled weapons. Bipods permit operators to easily rest a weapon on objects, like the ground or a wall, reducing their fatigue and increasing accuracy and stability. Bipods can be of fixed or adjustable length. Some can be tilted and also have their tilting point close to the barrel's central axis, allowing the weapon to tilt left and right.

A problem with conventional bipods has been in allowing adjustability of the bipod to suit a shooter's preference, rather than the shooter having to compensate for shortcomings of the bipod. A further shortcoming with conventional bipods is that various surfaces on which a bipod can be rested can affect the stability thereof, leading to reduced accuracy from a firearm supported thereon.

The current invention was conceived with these shortcomings in mind.

SUMMARY OF THE INVENTION

Reference herein to a 'rifle' is to be understood to refer to any firearm, whether rifled or smoothbore, from which a projectile (bullet or otherwise) is dischargeable, when in use. Accordingly, the use of a bipod generally facilitates accurate and precise aiming of such a rifle, where the rifle is supportable on a variety of surfaces allowing a marksman or shooter to aim said rifle.

According to a first aspect of the invention there is provided a rifle bipod comprising:

a rifle support configured for operatively receiving and supporting a portion of a rifle;

two legs each having a tubular upper and lower portion telescopically arranged with an urging element operatively urging said portions into an extended position and having a cam lock arrangement configured to allow infinite length adjustability between the telescoping upper and lower portions, each leg further having a foot attachment configured to releasably receive interchangeable feet whereby each leg is operatively able to engage a surface; and a stabilising arrangement pivotably attaching the legs to the rifle support at a commensurate off-vertical angle and having a biasing element configured to operatively bias both legs towards each other, and a linkage configured to maintain the off-vertical angle commensurate as the legs pivot apart, wherein the rifle support is height adjustable via the telescoping legs and the linkage maintaining the off-vertical angle commensurate whilst the feet are engaged with the surface.

In one example, the rifle support is configured to receive a rifle by defining a suitable rail attachment.

Typically, the rail attachment is selected from a group consisting of a Picatinny rail (also known as a MIL-STD-1913 rail), a Weaver rail, a NATO accessory rail, a Warsaw Pact rail, a UIT rail, KeyMod, M-LOK, or any other rail integration system.

Typically, the rail attachment includes a quick-release mechanism.

Typically, the rifle support is located at or proximate an apex of a triangle formed by the pivotally attached legs.

In one example, the rifle support is configured to receive and support a portion of a rifle such that a barrel of said rifle is above the apex.

Alternatively, the rifle support is configured to receive and support a portion of a rifle such that a barrel of said rifle is below the apex.

Typically, the lower portion of each leg is manufactured from titanium.

Typically, the urging element includes a spring, pneumatic and/or hydraulic biasing means arranged within the telescoping upper and lower portions.

In one example, an urging force provided by the urging element is selected according to a weight of a firearm to be supported by the bipod.

In one example, the urging element is configured so that an urging force thereof is user-configurable according to a weight of a firearm to be supported by the bipod.

Typically, the cam lock arrangement comprises an over-centre locking arrangement to secure the cam lock arrangement when locked.

Typically, the cam lock arrangement comprises a rotatable annulus eccentrically arranged about each leg and configured so that rotation of said annulus urges the eccentric annulus against the tubular portions to lock said telescoping portions in position with respect to each other.

In one example, the rotatable annulus comprises an internally interspaced pattern configured to complementarily receive and capture a pin defined on a leg to allow length adjustability between the telescoping upper and lower portions and/or lock a leg into an unextended or compressed position.

Typically, the foot attachment on each leg includes an interference-fit or press-fit attachment.

In one example, the interference-fit attachment includes a magnet to retain the feet therein.

In one example, the bipod includes interchangeable feet selected from a group consisting of claw feet, stake feet, magnetic attachment feet, and non-slip knob feet.

Typically, the stabilising arrangement is configured to allow the legs to be swivelled into a storage position wherein the legs lie longitudinally with a firearm received by the rifle support.

Typically, the biasing element comprises a spring configured to bias the legs towards each other.

In one example, the stabilising arrangement comprises an inverted triangular member with the rifle support fast at an upper side thereof so that the inverted triangular member points downwards, each leg pivotably attached at an upper vertex of said triangular member, the linkage comprising two links rotatably fast proximate the bottom vertex inside a vertically guiding slot and respectively fast to a leg below the upper vertex attachment, so that angling of the legs is facilitated by the bottom vertex attachment sliding within the guiding slot.

In one example, the linkage is configured to separate the legs at the off-vertical angle when the legs are attached to the triangular member.

Typically, the linkage includes a locking means configured to lock the linkage in position to maintain the commensurate off-vertical angle of the legs.

In one example, the locking means is configured to lock the bottom vertex attachment of the linkage in position in the vertical guiding slot.

In one example, the locking means comprises each link defining a rack and shared pinion arrangement, the pinion linked to a locking lever to allow the links to be locked in place via the locking lever.

In one example, each cam lock arrangement is linked to the locking means so that actuation of the locking means releases or locks each respective leg's cam lock arrangement and the linkage simultaneously.

Typically, the cam lock arrangement is linked to the locking means via a cable arrangement, said cam lock arrangement biased into a locking state with tension on a cable configured to counteract said bias and release the cam lock arrangement.

According to a second aspect of the invention there is provided a method of supporting a rifle, said method comprising the steps of:

attaching a rifle to the rifle bipod in accordance with the first aspect of the invention; and adjusting a height of the rifle support to suit a shooting position of a shooter.

BRIEF DESCRIPTION OF THE DRAWINGS

The description will be made with reference to the accompanying drawings in which.

DETAILED DESCRIPTION OF EMBODIMENTS

Figure 1:
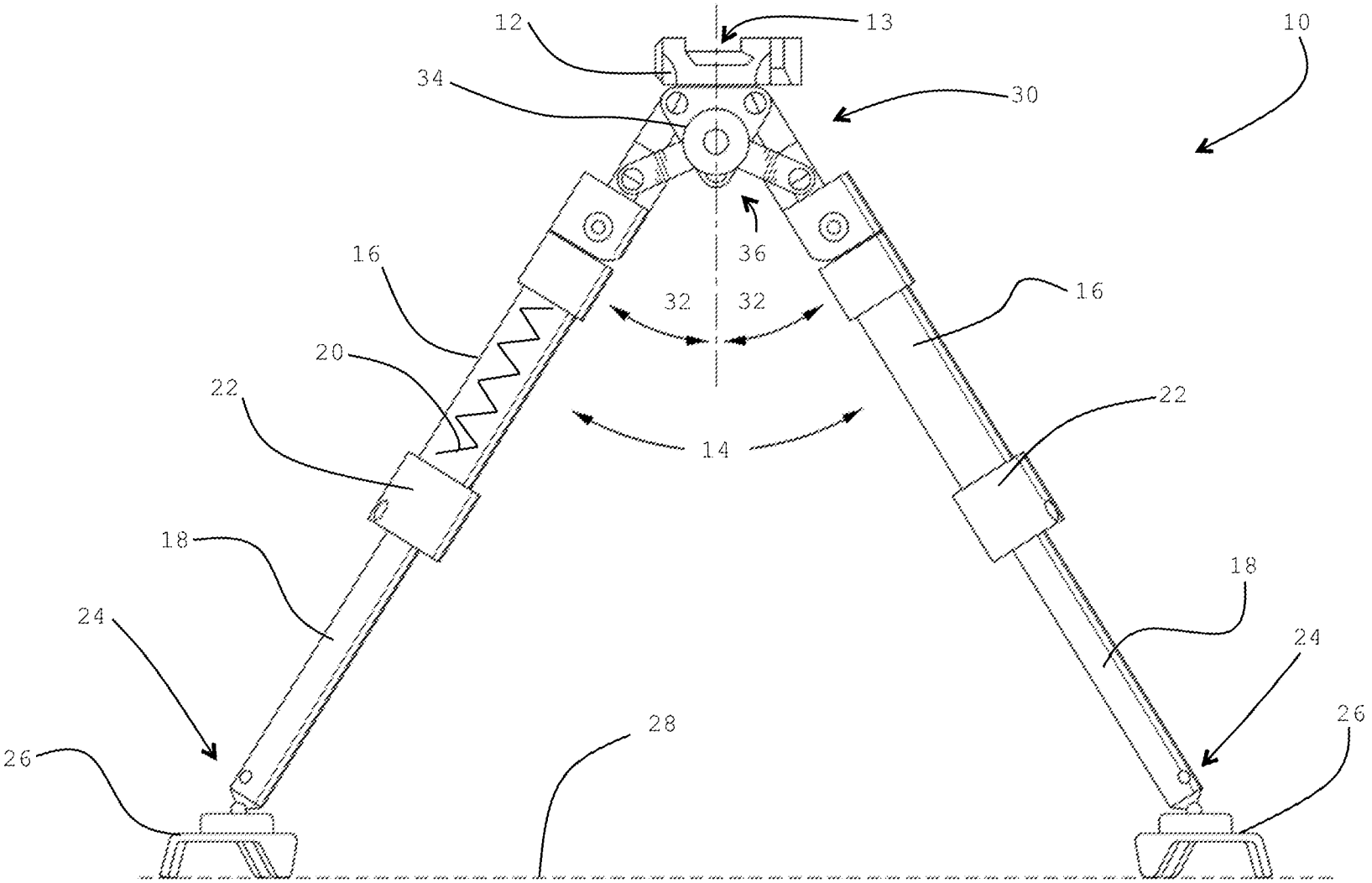
FIG. 1 is a diagrammatic front-view representation of one embodiment of a rifle bipod, in accordance with an aspect of the invention.

Further features of the present invention are more fully described in the following description of several non-limiting embodiments thereof. This description is included solely for the purposes of exemplifying the present invention to the skilled addressee. It should not be understood as a restriction on the broad summary, disclosure or description of the invention as set out above. In the figures, incorporated to illustrate features of the example embodiment or embodiments, like reference numerals are used to identify like parts throughout.

With reference now to the accompanying figures, there is shown one embodiment of a rifle bipod 10. The exemplified embodiment of the rifle bipod 10 broadly comprises a rifle support 12, two legs 14, and a stabilising arrangement 30. The bipod 10 is shown resting on a surface 28.

The rifle support 12 is typically configured for operatively receiving and supporting a portion of a rifle 8 thereon and/or thereby. In the present example, the rifle support 12 is configured to receive a rifle (not shown) by defining a suitable rail attachment 13, as shown. Typically, the rail attachment is selected from a group consisting of a Picatinny rail (also known as a MIL-STD-1913 rail), a Weaver rail, a NATO accessory rail, a Warsaw Pact rail, a UIT rail, KeyMod, M-LOK, or any other rail integration system. Typically, the rail attachment 13 includes a quick-release mechanism, as is known in the art. Similarly, other types of attachment are possible, e.g. threaded, press-fit, friction fit, etc., and are within the scope of the present invention.

Figures 5A, 5B:
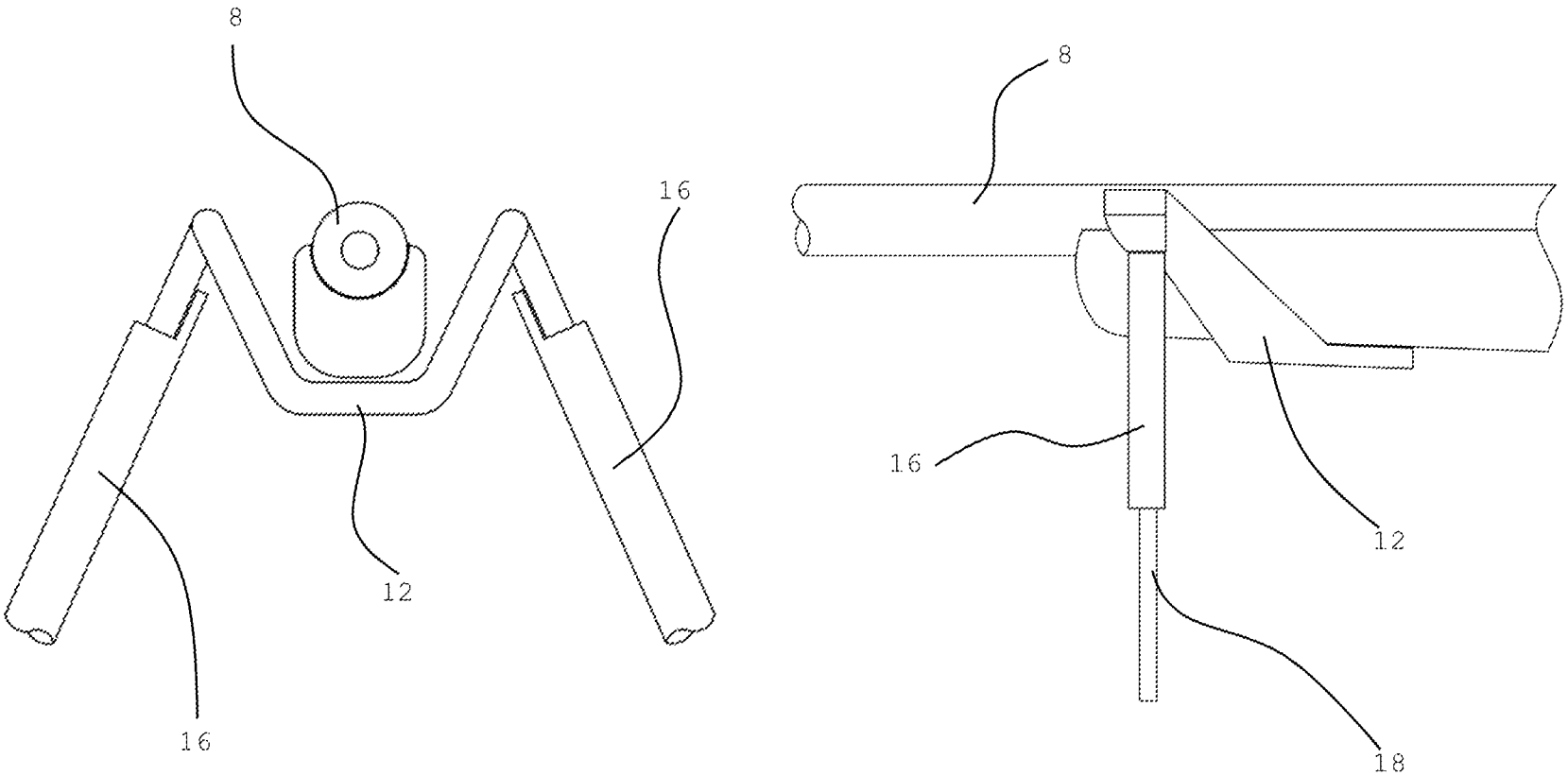
FIGS. 5A and 5B are diagrammatic front- and side-view representations of a further embodiment of a rifle bipod with a rifle support supporting a rifle below an apex of a triangle formed by the legs.

Typically, the rifle support 12 is located at or proximate an apex of a triangle formed by the pivotally attached legs 14. In one example, the rifle support 12 is configured to receive and support a portion of a rifle 8 such that a barrel of said rifle is above the apex. Alternatively, as shown in FIG. 5, the rifle support 12 can also be configured to receive and support a portion of a rifle 8 such that a barrel of said rifle is below the apex. This arrangement may have benefits concerning a lower centre of gravity of the bipod 10 with attached rifle 8 to allow ease-of-use.

The two legs 14 each typically comprises a tubular upper portion 16 and a lower portion 18 which have been telescopically arranged within each other, as shown. The lower portions 16 of each leg 14 are typically manufactured from titanium in one example, but the skilled addressee will appreciate that various other materials can be used for the constituent parts of the bipod 10, depending on requirements, including steel, aluminium, polymer materials, and the like.

Each leg 14 also includes an urging element 20 that urges said portions 16 and 18 into an extended position, i.e. pushes them telescopically apart. The urging element is typically a spring or similar device. The skilled addressee will appreciate that the upper and lower portions 16 and 18 have been arranged such that a suitable detent or stop (not shown)

prevents the upper and lower portions 16 and 18 from separating entirely, i.e. pull apart.

As mentioned, the urging element 20 typically includes a coiled spring arranged within the telescoping upper and lower portions 16 and 18, but other configurations are possible, e.g. a compressible gas, or similar pneumatic or hydraulic arrangements, etc. In a typical example, an urging force provided by the urging element 20 is selected according to a weight of a firearm to be supported by the bipod 10. In another example, the urging element 20 is configured so that an urging force provided thereby is user-configurable according to a weight of a firearm to be supported by the bipod, i.e. to allow firearms of various weights to be supported.

It is to be appreciated that by selecting an appropriate urging force for the urging element 20 generally allows a supported firearm to be suspended or create an impression with a shooter that the firearm 'floats' such that minor and effortless motions are required to alter the aim of such a firearm.

Each leg further includes a cam lock arrangement 22 which is generally configured to allow infinite length adjustability between the telescoping upper and lower portions 16 and 18. This allows the upper and lower portions 16 and 18 to be adjusted along the entire length of motion provided by such telescopic arrangement to be locked in place according to a shooter's requirements.

One example of the cam lock arrangement 22 comprises an over-centre locking arrangement to secure the cam lock arrangement 22 when locked. The cam locking arrangement may also be configured to lock the cam lock arrangement 22 in a neutral position, so that during adjustment of the legs 14, the cam lock arrangement 22 is positively in a position that allows the legs 14 to freely move, e.g. a ball and spring which fits into a suitable indent to locate the neutral position (example shown in FIG. 7A), a circlip or retaining ring arrangement, or the like.

Typically, the cam lock arrangement 22 comprises a rotatable annulus 60 eccentrically arranged about each leg 14 and configured so that rotation of said annulus urges the eccentric annulus against the tubular portions 16 or 18 to lock the telescoping portions 16 and 18 in position with respect to each other. The skilled addressee will appreciate that other locking arrangements are possible and within the scope of the present invention.

Figures 7A, 7B, 7C:
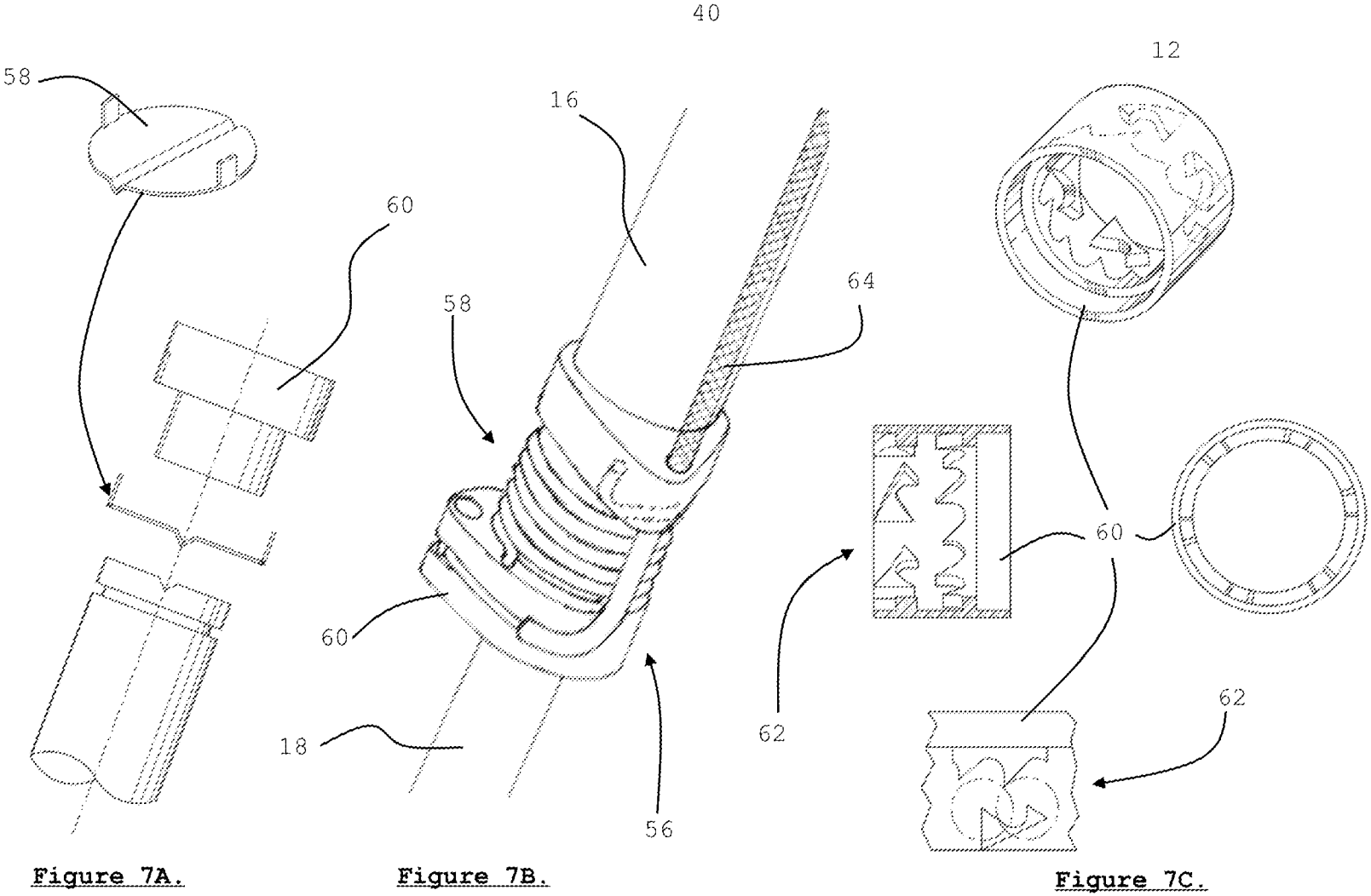
FIGS. 7A, 7B and 7C are diagrammatic representations of different examples of cam lock arrangements of the bipod's legs.

For example, with reference to FIG. 7, there are shown various types of potential locking arrangements 22. FIG. 7A shows an example of an over-centre locking arrangement with a circlip-type biasing element 58. FIG. 7B shows an example of a cam lock arrangement 22 which is linked to the locking means 50 (described in more detail below) via a cable arrangement 56.

FIG. 7C shows one example of the rotatable annulus 60 comprising an internally interspaced pattern 62, such as the exemplified saw-tooth pattern 62, configured to complementarily receive and capture a pin defined on a leg to allow infinite length adjustability between the telescoping upper and lower portions 16 and 18 and/or lock a leg into an unextended position. For example, the rotatable annulus 60 comprising an internally interspaced pattern 62 can be used similar to a retractable or 'click' pen so that when the rifle support 12 is pushed down to compress the legs, the annulus 60 captures a suitable pin to engage and lock the legs in a compressed or unextended position, i.e. minimum length. The bipod can then be folded back for stowing. If needed again, the rifle support 12 can be urged downward to disengage the pin from the annulus to again allow length adjustability of the legs.

Each leg 14 also typically includes a foot attachment 24 which is configured to releasably receive interchangeable feet 26 whereby each leg is operatively able to engage a surface 28. Typically, the foot attachment 24 on each leg 14 includes a press-fit attachment, i.e. having a somewhat elastic nylon ring into which a foot 26 can be pressed and held in place, or a dowel pin configured to engage a suitable aperture in the foot attachment, a magnet to retain the feet therein, etc. Other configurations are possible and within the scope of the present invention. A variety of feet 26 are possible according to requirements, including rubber ball feet, pointed feet, claw feet, stake feet, magnetic attachment feet for securing the bipod to a magnetic surface, non-slip knob feet, etc. Some feet 26 may be able to swivel via a suitable ball-and-socket configuration, where other feet 26 may be fixed, or the like.

The rifle bipod 10 further includes a stabilising arrangement 30 which is configured to pivotably attach the legs 14 to the rifle support 12 at a commensurate off-vertical angle 32, as shown. Reference to such off-vertical angle 32 refers to the angle formed by each leg with the vertical, as indicated. Similarly, the stabilising arrangement 30 is configured to substantially maintain the angle 32 of each leg the same or commensurate with the other, as described in more detail below.

Figure 2:
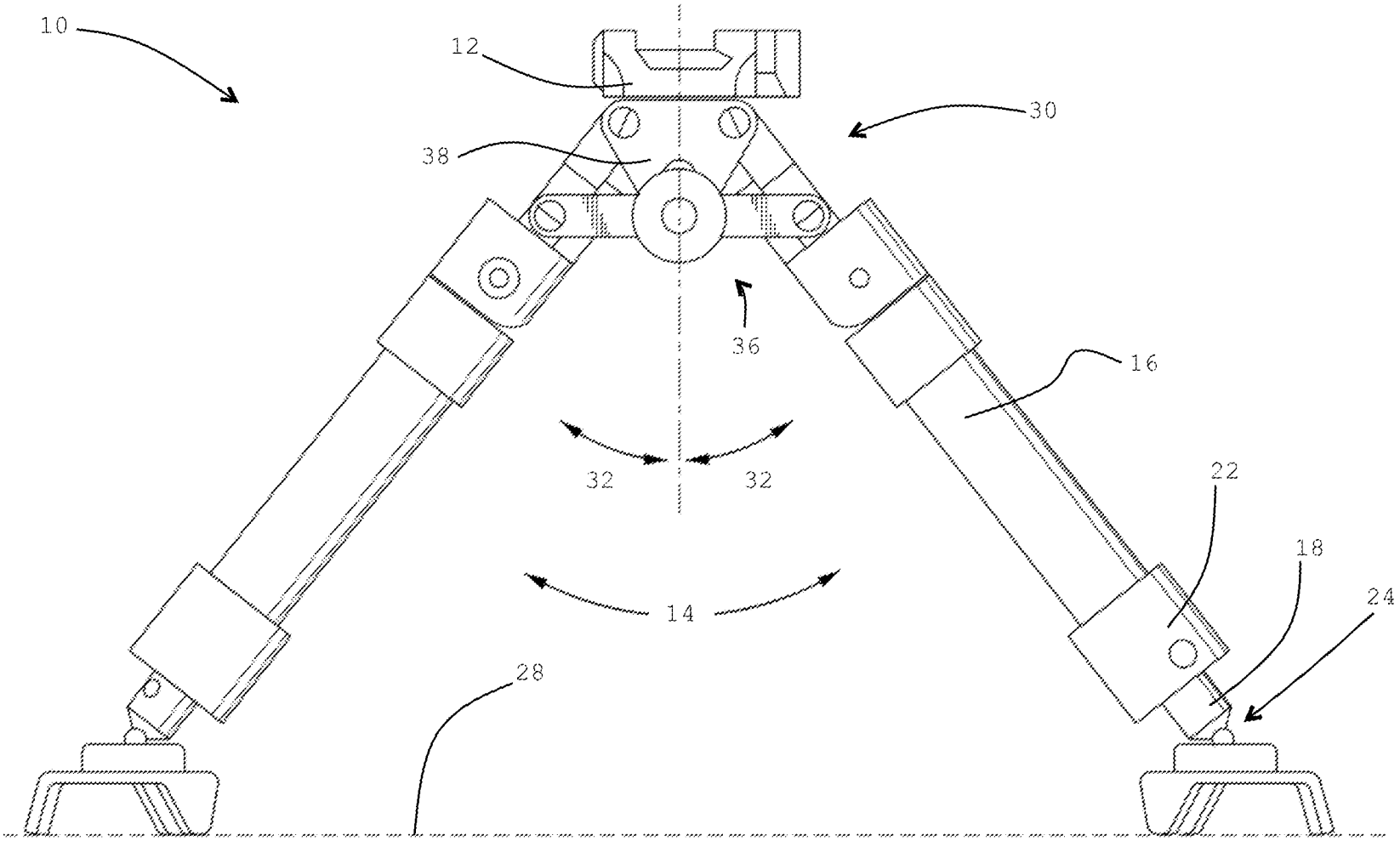
FIG. 2 is a diagrammatic front-view representation of the rifle bipod of FIG. 1, showing the rifle support adjusted downwards.

The stabilising arrangement 30 includes a biasing element 34 which is configured to operatively bias both legs 14 towards each other, such as a coiled or leaf spring configured to bias the legs 14 towards each other. Accordingly, when there is no downward force, such as the weight of a rifle supported by the rifle support 12, acting on the legs 14, the legs 14 will be maintained in a particular off-vertical angle 32, an example of which is shown in FIG. 1. Conversely, when a downward force acts upon the legs 14, the legs 14 can shorten via the telescoping upper and lower portions 16 and 18 such that the off-vertical angle 32 increases, as shown in FIG. 2.

The stabilising arrangement 30 further includes a linkage 36 which is configured to maintain the off-vertical angle 32 commensurate as the legs 14 pivot apart, so that the rifle support 12 is height adjustable closer to, or further away from, the surface 28 via the telescoping legs 14 and the linkage 36 maintaining the off-vertical angle 32 similar or commensurate whilst the feet 26 are engaged with the surface 28.

Figure 3:
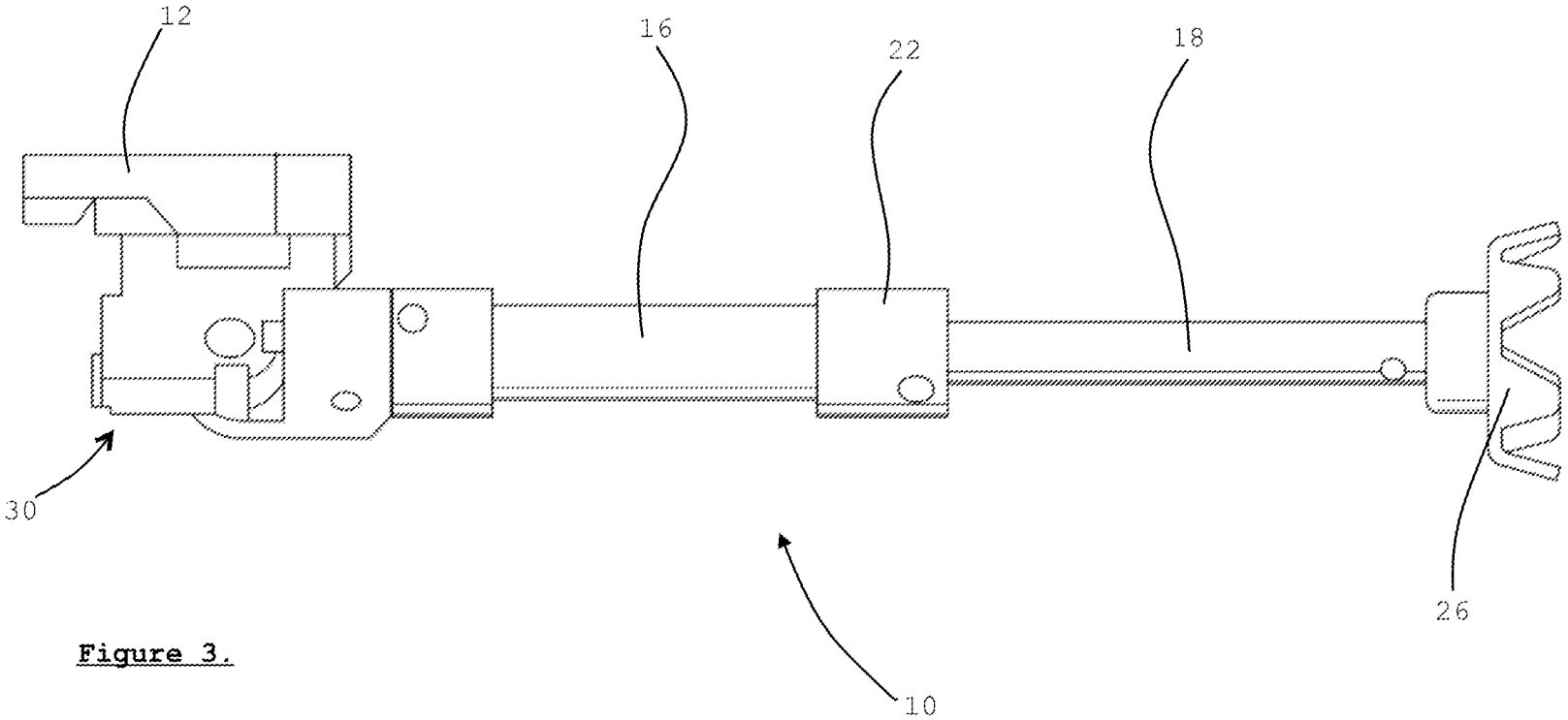
FIG. 3 is a diagrammatic side-view representation of the rifle bipod of FIG. 1, showing the legs swivelled into a storage position.

As shown in FIG. 3, the stabilising arrangement 30 is typically configured to allow the legs 14 to be swivelled into a storage position wherein the legs 14 lie longitudinally with a firearm received by the rifle support 12.

Figure 4:
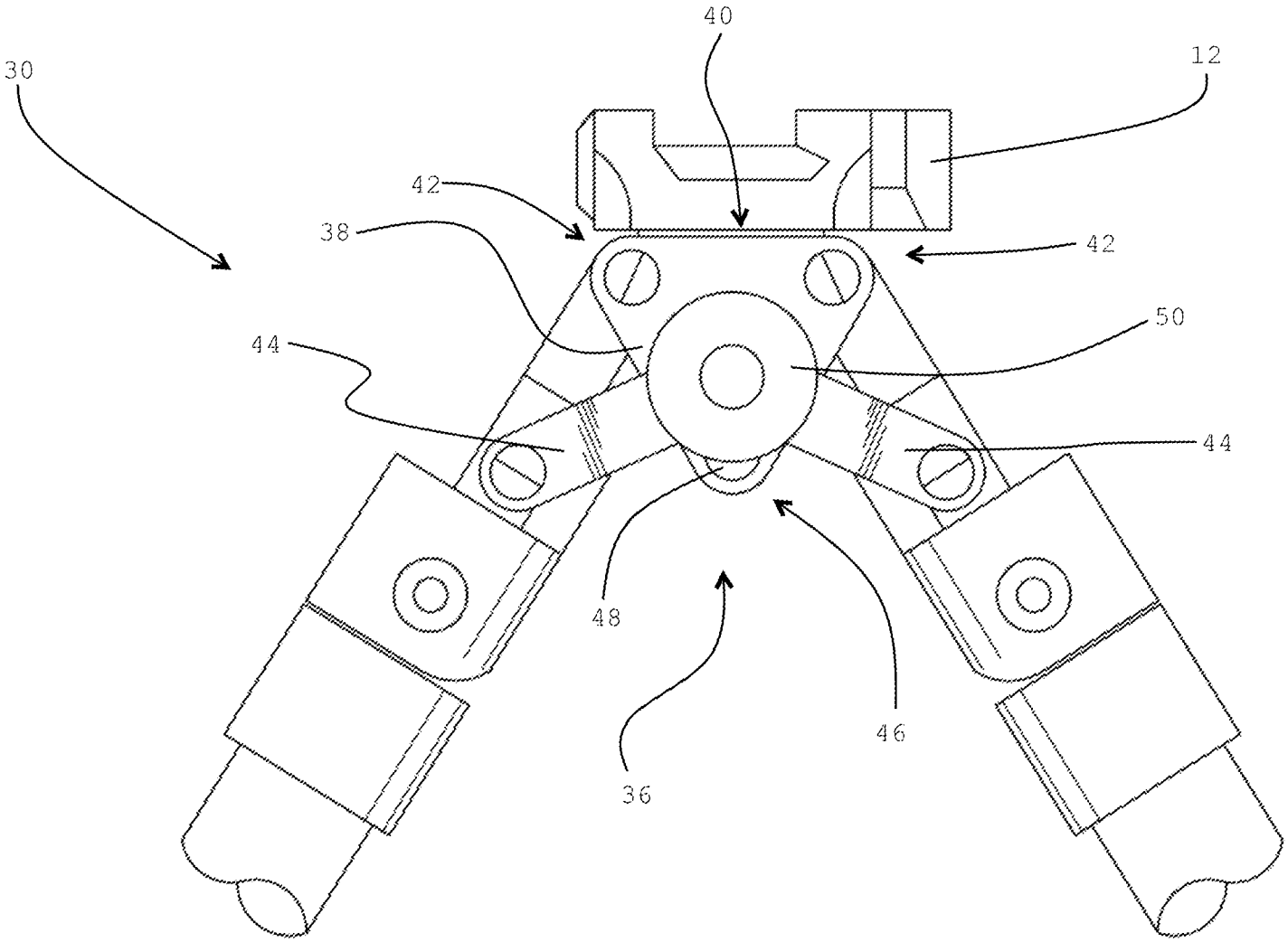
FIG. 4 is a diagrammatic front-view representation of the stabilising arrangement of the rifle bipod of FIG. 1.

FIG. 4 shows a closer view of one example of the stabilising arrangement 30 which comprises an inverted triangular member 38 with the rifle support 12 fast at an upper side 40 thereof. In such a configuration, the inverted triangular member 38 points downwards, as shown, with each leg 14 pivotably attached at an upper vertex 42 of the triangular member 38, as shown. The linkage 36 comprises two links 44 rotatably fast proximate the bottom vertex 46 inside a vertically guiding slot 48 with each link 44 respectively fast to a leg 14 below the upper vertex attachment 42. In this manner, angling (via pivoting) of the legs 14 is facilitated by the bottom vertex attachment 46 sliding up and down within the guiding slot 48, as will be apparent to the skilled addressee.

In one example, the linkage 36 is configured to separate the legs 14 at the off-vertical angle 32 when the legs are attached to the triangular member 38. In such an example, a length of each link 44 determines the off-vertical angle 32 when there is no incident downward force applied to the rifle support 12, as described above. In one example, the bottom vertex attachment 46 also includes a locking means 50, such as a bolt or nut, wingnut, etc., configured to lock the bottom vertex attachment 46 of the linkage 36 in position in the vertical guiding slot 48. Such locking means 50 locks the legs 14 in a particular off-vertical angle 32, as per requirements.

In use, a shooter attaches a rifle to the bipod 10 via the rifle support 12. The legs 14 are able to lengthen or shorten whilst the stabilising arrangement 30 facilitates in maintaining the off-vertical angle 32 of the legs 14, as well as maintaining the rifle support 12 substantially horizontal.

Figure 6A:
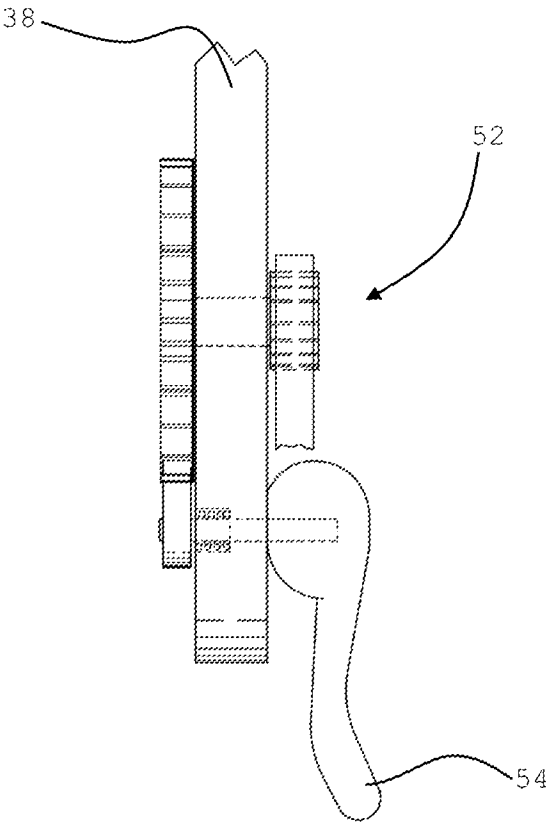
FIGS. 6A and 6B are diagrammatic front- and side-view representations of a rifle bipod with locking means comprising each link having a rack and shared pinion arrangement with a shared locking lever.
Figure 6B:
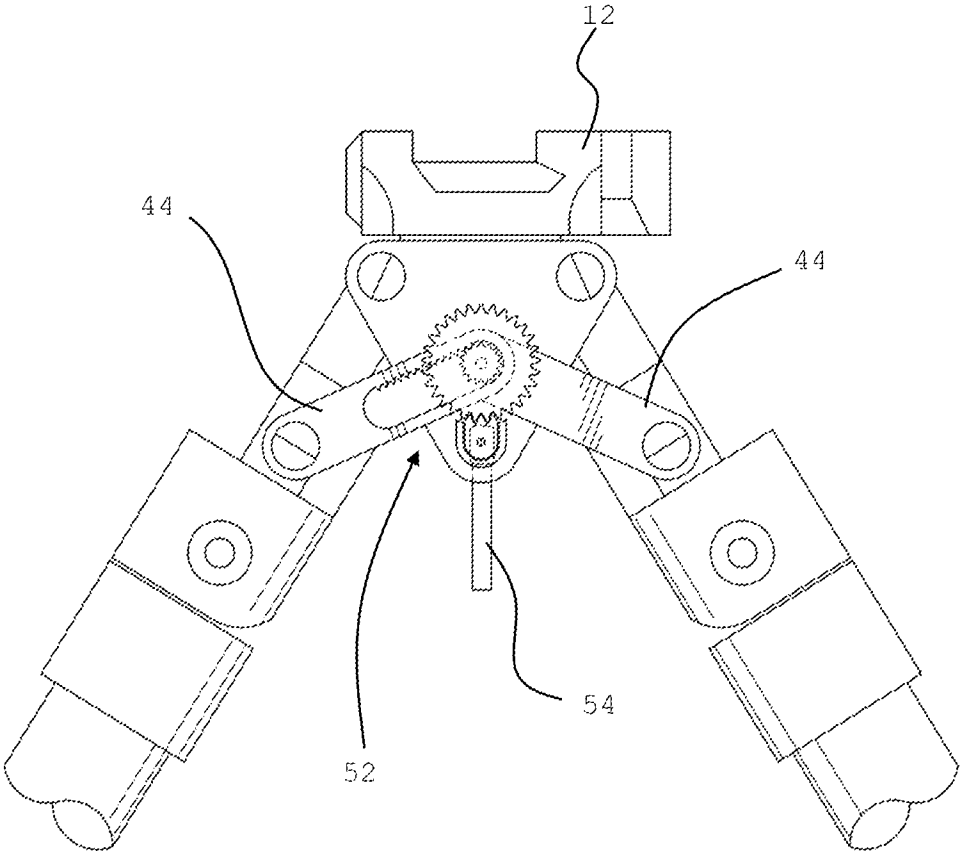

In a further example, shown in FIG. 6, the locking means 50 comprises each link 44 defining a rack and shared pinion arrangement 52, with this shared pinion linked to a locking lever 54 to allow the links 44 to be locked in place via the locking lever 54. In one example, each cam lock arrangement 22 is linked to the locking means 50 so that actuation of the locking means releases or locks each respective leg's cam lock arrangement 22 and the linkage 36 simultaneously. In the example of FIG. 7B, the cam lock arrangement 22 is linked to the locking means 50 via a cable arrangement 56, wherein the cam lock arrangement 22 is biased into a locking state by bias spring 58 with tension on a cable 64 configured to counteract said bias and release the cam lock arrangement 22. Other variations hereon as possible and within the scope of the present invention.

Accordingly, embodiments are possible wherein a user is required to actuate each respective lock arrangement 22 for each leg, as well as the locking means 50 to locks the legs 14 in a particular off-vertical angle 32, as per requirements. Similarly, the bipod 10 can be configured with a single locking lever 54 or the like, whereby each respective lock arrangement 22 for each leg and the locking means 50 can be simultaneously actuated. Variations hereof are possible and within the scope of the present invention. For example, the locking lever 54 may be linked to the linkage via a gear or gears to lock the linkage in place, or the like.

The skilled addressee will further appreciate that the present invention also includes an associated method of supporting a rifle. Such a method typically comprises the steps of attaching a rifle 8 to the rifle bipod 10 and adjusting a height of the rifle support 12 to suit a shooting position of a shooter.

Applicant believes is particularly advantageous that the present invention provides for a rifle bipod 10 that allows infinite adjustability of the legs 14 via the cam lock arrangement 22. It is further believed to be advantageous that the stabilising arrangement 30 maintains the off-vertical angle of each leg 14 commensurate to facilitate in allowing the feet 26 of the bipod 10 to engage with a surface 28 that may be angled and/or uneven such that the rifle support 12 is maintained substantially level to facilitate aiming of a rifle supported thereby.

Optional embodiments of the present invention may also be said to broadly consist in the parts, elements and features referred to or indicated herein, individually or collectively, in any or all combinations of two or more of the parts, elements or features, and wherein specific integers are mentioned herein which have known equivalents in the art to which the invention relates, such known equivalents are deemed to be incorporated herein as if individually set forth. In the example embodiments, well-known processes, well-known device structures, and well-known technologies are not described in detail, as such will be readily understood by the skilled addressee.

The use of the terms "a", "an", "said", "the", and/or similar referents in the context of describing various embodiments (especially in the context of the claimed subject matter) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. As used herein, the term "and/or" includes any and all combinations of one or more of the associated listed items. No language in the specification should be construed as indicating any non-claimed subject matter as essential to the practice of the claimed subject matter.

It is to be appreciated that reference to "one example" or "an example" of the invention, or similar exemplary language (e.g., "such as") herein, is not made in an exclusive sense. Various substantially and specifically practical and useful exemplary embodiments of the claimed subject matter are described herein, textually and/or graphically, for carrying out the claimed subject matter.

Accordingly, one example may exemplify certain aspects of the invention, whilst other aspects are exemplified in a different example. These examples are intended to assist the skilled person in performing the invention and are not intended to limit the overall scope of the invention in any way unless the context clearly indicates otherwise. Variations (e.g. modifications and/or enhancements) of one or more embodiments described herein might become apparent to those of ordinary skill in the art upon reading this application. The inventor(s) expects skilled artisans to employ such variations as appropriate, and the inventor(s) intends for the claimed subject matter to be practiced other than as specifically described herein.

The invention claimed is:

1. A rifle bipod comprising:

a rifle support configured for operatively receiving and supporting a portion of a rifle;

two legs each having a tubular upper and lower portion telescopically arranged with an urging element operatively urging said portions into an extended position and having a cam lock arrangement configured to allow infinite length adjustability between the telescoping upper and lower portions, each leg further having a foot attachment configured to releasably receive interchangeable feet whereby each leg is operatively able to engage a surface; and a stabilising arrangement pivotably attaching the legs to the rifle support at a commensurate off-vertical angle and having a biasing element configured to operatively bias both legs towards each other, and a linkage configured to maintain the off-vertical angle commensurate as the legs pivot apart, wherein the stabilising arrangement comprises an inverted triangular member with the rifle support fast at an upper side thereof so that the inverted triangular member points downwards, each leg pivotably attached at an upper vertex of said triangular member, the linkage comprising two links rotatably fast proximate the bottom vertex inside a vertically guiding slot and respectively fast to a leg below the upper vertex attachment, so that angling of the legs is facilitated by the bottom vertex attachment sliding within the guiding slot, and wherein the rifle support is height adjustable via the telescoping legs and the linkage maintaining the off-vertical angle commensurate whilst the feet are engaged with the surface.

2. The rifle bipod of claim 1, wherein the rifle support is configured to receive a rifle by defining a suitable rail attachment selected from a group consisting of a Picatinny rail, a Weaver rail, a NATO accessory rail, a Warsaw Pact rail, a UIT rail, KeyMod, and M-LOK.

3. The rifle bipod of claim 1, wherein the rifle support is located at or proximate an apex of a triangle formed by the pivotally attached legs and the rifle support is configured to receive and support a portion of a rifle such that a barrel of said rifle is above or below the apex.

4. The rifle bipod of claim 1, wherein the urging element includes a spring arranged within the telescoping upper and lower portions.

5. The rifle bipod of claim 1, wherein an urging force provided by the urging element is selected according to a weight of a firearm to be supported by the bipod.

6. The rifle bipod of claim 1, wherein the urging element is configured so that an urging force thereof is user-configurable according to a weight of a firearm to be supported by the bipod.

7. The rifle bipod of claim 1, wherein the cam lock arrangement comprises an over-centre locking arrangement to secure the cam lock arrangement when locked.

8. The rifle bipod of claim 1, wherein the cam lock arrangement comprises a rotatable annulus eccentrically arranged about each leg and configured so that rotation of said annulus urges the eccentric annulus against the tubular portions to lock said telescoping portions in position with respect to each other.

9. The rifle bipod of claim 1, wherein the cam lock arrangement comprises a rotatable annulus having an internally interspaced pattern configured to complementarily receive and capture a pin defined on a leg to allow length adjustability between the telescoping upper and lower portions and/or lock a leg into an unextended or compressed position.

10. The rifle bipod of claim 1, wherein the foot attachment on each leg includes an interference-fit or press-fit attachment.

11. The rifle bipod of claim 1, which includes interchangeable feet selected from a group consisting of claw feet, stake feet, magnetic attachment feet, and non-slip knob feet.

12. The rifle bipod of claim 1, wherein the stabilising arrangement is configured to allow the legs to be swivelled into a storage position wherein the legs lie longitudinally with a firearm received by the rifle support.

13. The rifle bipod of claim 1, wherein the biasing element comprises a spring, pneumatic and/or hydraulic biasing means configured to bias the legs towards each other.

14. The rifle bipod of claim 1, wherein the linkage is configured to separate the legs at the off-vertical angle when the legs are attached to the triangular member.

15. The rifle bipod of claim 14, wherein the linkage includes a locking means configured to lock the linkage in position to maintain the commensurate off-vertical angle of the legs.

16. The rifle bipod of claim 15, wherein the locking means is configured to lock the bottom vertex attachment of the linkage in position in the vertical guiding slot.

17. The rifle bipod of claim 15, wherein the locking means comprises each link defining a rack and shared pinion arrangement, the pinion linked to a locking lever to allow the links to be locked in place via the locking lever.

18. The rifle bipod of claim 14, wherein each cam lock arrangement is linked to the locking means so that actuation of the locking means releases or locks each respective leg's cam lock arrangement and the linkage simultaneously.

19. The rifle bipod of claim 18, wherein the cam lock arrangement is linked to the locking means via a cable arrangement, said cam lock arrangement biased into a locking state with tension on a cable configured to counteract said bias and release the cam lock arrangement.

* * * * *